United States Patent [19]

Cheng

[11] Patent Number: 4,515,837

[45] Date of Patent: May 7, 1985

[54] RIBBON FOR FORMING A DECORATIVE BOW

[76] Inventor: Peter S. C. Cheng, 32 Wyndham St., Flat 10-C, Hong Kong, Hong Kong

[21] Appl. No.: 584,630

[22] Filed: Feb. 29, 1984

[51] Int. Cl.[3] ..... D04D 7/10

[52] U.S. Cl. ..... 428/4; 223/46; 428/101; 428/136

[58] Field of Search ..... 428/4, 5, 24, 25, 26, 428/101, 136; 223/46

[56] References Cited

U.S. PATENT DOCUMENTS

| | | | |
|---|---|---|---|
| 2,841,905 | 7/1958 | Wancheck | 428/5 |
| 2,845,736 | 8/1958 | Crawford | 428/5 |
| 2,849,821 | 9/1958 | Doig | 428/5 |
| 3,010,236 | 11/1961 | Doig | 428/5 |
| 3,030,719 | 4/1962 | Enomoto | 428/26 |
| 3,632,464 | 1/1972 | Grikis | 428/4 |
| 3,637,455 | 1/1972 | Pearson et al. | 428/4 |
| 3,954,212 | 5/1976 | Bolis | 428/4 X |
| 4,329,382 | 5/1982 | Truskolaski et al. | 428/4 |
| 4,449,652 | 5/1984 | Coppins et al. | 428/4 X |
| 4,476,168 | 10/1984 | Aoyama | 428/24 X |

FOREIGN PATENT DOCUMENTS

| | | | |
|---|---|---|---|
| 2921674 | 12/1980 | Fed. Rep. of Germany | 428/4 |
| 1200982 | 7/1959 | France | 428/5 |

*Primary Examiner*—Henry F. Epstein
*Attorney, Agent, or Firm*—Bacon & Thomas

[57] ABSTRACT

A bow-forming ribbon has a decorative flexible ribbon member and a drawstring connected loosely to the ribbon at points along its length by relatively stiff retainer members. Each retainer member extends generally transversely across the ribbon member, and each is inclined with respect to the transverse direction at an angle. Each retainer member is inclined at an angle different from that of the preceding retainer member. On forming the ribbon into a bow by pulling the drawstring relative to the ribbon, the inclined retainer members tend to skew the adjacent loops or segments of the bow relative to one another, so that loops distributed at various angles around the axis of the bow are formed, thus avoiding the tendency for the successive loops to seat themselves on one another in a fan shape.

9 Claims, 5 Drawing Figures

RIBBON FOR FORMING A DECORATIVE BOW

The present invention relates to a ribbon for forming a decorative bow, to be applied to wrapped gifts, for example.

It is known to provide a ribbon with a drawstring connected loosely to the ribbon at points along its length and secured to the ribbon at one end so that the user of the ribbon can draw the ribbon into a number of arcuate loops by pulling on the drawstring. One advantage of this arrangement is that the ribbon can be packed flat, thus greatly facilitating and reducing the costs of storage and transport of the items as compared with preformed bows which are relatively bulky and need to be packed in crush-proof containers.

Prior devices of which the inventor is aware have, however, suffered from the disadvantage that on pulling the drawstring, the ribbon tends to fold itself into loops which are all aligned in one vertical plane, thus forming a fan shape. This is inconvenient to the user who normally requires the bow to be arranged in a more decorative rosette or pom-pom form, and necessitates the user having to pull on the individual loops to rotate them laterally and rearrange them so that the loops are spaced angularly around the axis of the bow. Apart from being time-consuming, this manipulation presents risk of the bow becoming torn, damaged or soiled.

The present invention provides a bow-forming ribbon comprising at least one decorative flexible ribbon member, a series of relatively stiff retainer members which may be plate form, or may be wire, spaced apart at intervals along the length of the ribbon member and each being restrained against movement relative to the ribbon member and defining an aperture extending generally transversely across the ribbon member at an angle with respect to the transverse direction, each retainer member extending at an angle different from that of the adjacent preceding constraining member, and at least one drawstring member running freely through the apertures defined by the successive retainer members.

With this arrangement, as the bow is being formed by pulling on the drawstring, each relatively stiff retainer member tends to seat itself on the bow loop that is being formed immediately adjacent thereto in an angularly skewed orientation relative to the latter, and tends to skew each loop of the bow relative to the loop beneath, so that the loops of the bow are arranged in angularly spaced rosette or pom-pom like form. Desirably each retainer member is inclined at an angle opposite to that of the preceding member.

One embodiment of the present invention is now described in more detail, by way of example only, with reference to the accompanying drawings, in which.

Figure 1:
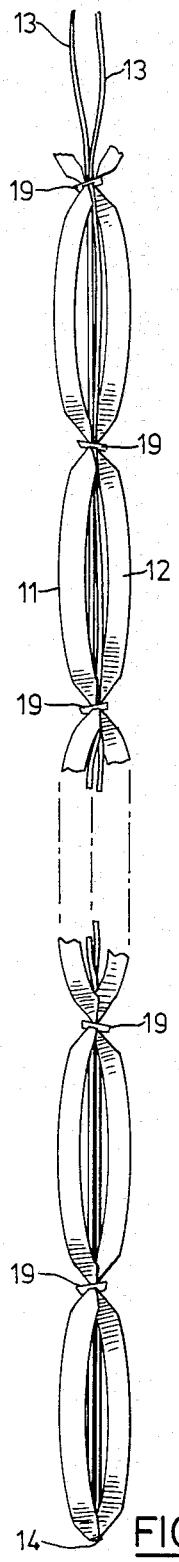
FIG. 1 shows a bow-forming ribbon in accordance with the invention.

Referring to the drawings, FIG. 1 shows two ribbon members 11 and 12 disposed in face-to-face relationship. The members 11 and 12 are formed by taking a length of conventional decorative ribbon material, e.g. a conventional synthetic plastic having a satin like fibrous texture, and folding it at its middle 14. A draw-string 13, which may be formed of a narrower width of the material of the members 11 and 12 is connected to the members 11 and 12, and passes between the two members 11 and 12. In the example illustrated, the draw-string 13 is a double length of material which is tied in a knot at its middle around the middle portion 14 of the folded-over ribbon members 11 and 12. Although in the example illustrated the ribbon is formed from two ribbon members 11 and 12 and a double length of the draw-string material 13 is provided, as will be appreciated, the ribbon may instead comprise only a single length of the ribbon material 11, and only a single drawstring 13 may be provided, attached to the single ribbon member 11 at one end.

Figure 2:
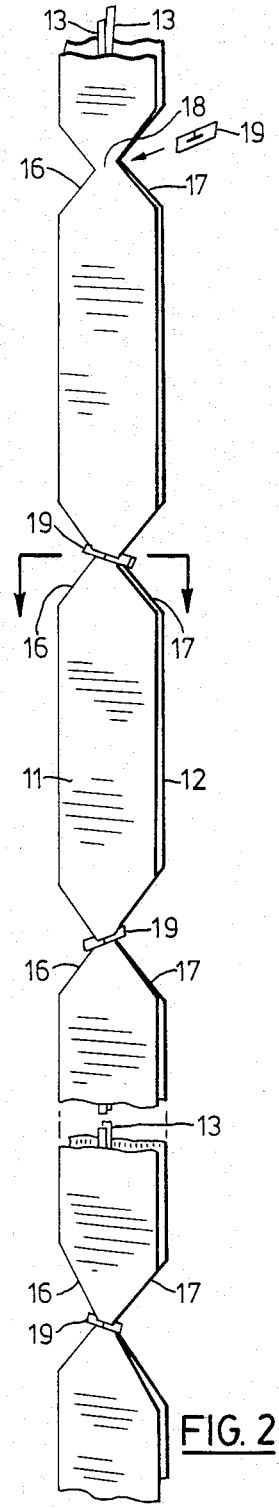
FIG. 2 shows a partially fragmentary view of the ribbon of FIG. 1 on an enlarged scale, and illustrating the method of assembly of the ribbon.

As best seen in FIG. 2, each ribbon member 11 and 12 is formed into a series of segments, preferably of approximately uniform length, by V-shaped indentations 16 and 17 cut on opposte sides of the ribbon members.

The indentations 16 and 17 are offset longitudinally from one another on opposite edges of the ribbon members 11 and 12 so that a narrow neck portion 18 is formed between each indentation which has its narrowest portion inclining at a small angle, e.g. about 30° to 40°, with respect to the transverse width of the ribbon members 11 and 12. The successive pairs of indentations 16 and 17 are formed so that each neck portion 18 inclines at an angle different from that of the preceding neck portion. In the preferred form, as shown in FIG. 2, the angle of inclination of each neck portion 18 is equal, but each inclines in a direction opposite to that of the preceding neck portion 18.

Figure 3:
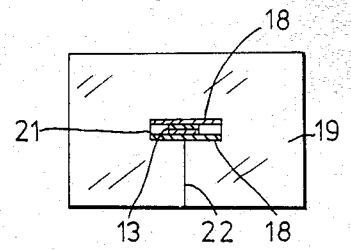
FIG. 3 shows a cross-section on an enlarged scale taken on the line 3—3 in FIG. 2.

A retainer member 19 is applied around each neck portion 18. Each retainer member comprises a small piece of a sheet material which is relatively stiff compared to the ribbon members 11 and 12. The retainer member may, for example, comprise a piece of thin and stiff plastic material e.g. a cellulose plastic material. The retainer member 19 is provided with a central aperture 21 of a width to receive the narrow neck portions 18 of the ribbon members 11 and 12 and the drawstring members 13, the latter being received sufficiently loosely that they can be pulled relatively freely between the neck portions 18. The retainer member 19 is formed with a cut 22 extending inwardly from one edge to the aperture 21. The retainer member 19 is applied by flexing it slightly to open the cut portion 22, so that the neck portions 18 and the draw-string members 13 can be introduced into the aperture 21. As seen in FIG. 3, the neck portions 18 are received snugly in the aperture 21, so that the retainer member 19 is retained against movement longitudinally relative to the ribbon members 11 and 12, and adopts and maintains the orientation of the narrow neck portion 18. Each retainer member 19 is thus inclined at the same angle as the narrow neck portion 18, and is in the form of a small plate presenting planar front and rear faces extending generally perpendicularly of the plane of the ribbon members 11 and 12, these faces being inclined with respect to the transverse width of the ribbon members 16 and 17 and, in the example shown, each retainer member 19 being inclined in a direction opposite from that of the preceding retainer member 19.

As will be appreciated, in order to locate the retainer members 19 relative to the ribbon members 16 and 17, and to orientate them at the desired angles, it is not necessary to provide indentations of the V-shape illustrated. For example, a simple cut may be formed inwardly from each edge of the ribbon member, the cuts being offset to provide a narrow land or intervening portion around which the retainer member 19 may be clipped.

Figure 4:
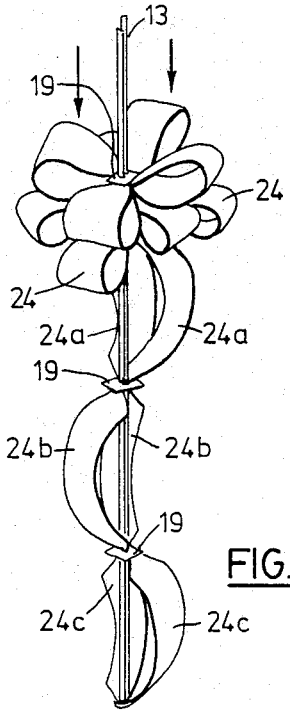
FIG. 4 illustrates the procedure of forming the ribbon into a bow.
Figure 5:
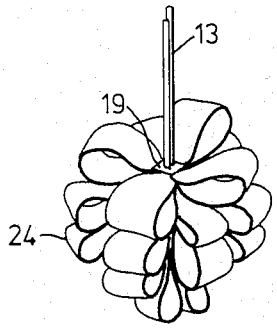
FIG. 5 shows the completed bow.

In use, the ribbon in the flat form illustrated in FIGS. 1 and 2 is converted into a decorative pom-pom or rosette-like bow by grasping the free ends of the drawstrings 13 in one hand, and retaining a portion of the drawstrings 13 adjacent the retainer member 19 adjacent the free ends 13 lightly between the finger and thumb of the other hand. The drawstrings 13 are then pulled outwardly, with the finger and thumb engaging the underside of the retainer member 19, so that the segments of the ribbon members 11 and 12 between the indentations 16 and 17 are gathered up into loops 24. Because of the angled orientation of the retainer members 19, these tend to seat themselves on the bow loops, for example the bow loops 24*a*, 24*b*, and 24*c* in FIG. 4, at angularly skewed orientations. Thus, the successive loops 24*a*, 24*b*, and 24*c* tend to be skewed angularly relative to one another at differing angles around the axis of the drawstrings 13 so that, instead of the loops 24 tending to superimpose themselves one on the other, the successive loops become arranged at differing angles spaced around the axis of the drawstrings 13 so that a bow is formed as shown in FIG. 5 with the loops 24 arranged at varying angles around the axis of the drawstrings 13, to provide a desired attractive rosette or pom-pom like form. It will be appreciated that FIG. 5 shows the completed bow in an inverted position relative to its normal position of use.

Once the bow is formed, the drawstrings 13 may be knotted adjacent the retainer member 19 exposed on the underside of the completed bow, and the free ends of the drawstrings 13 may be cut off. Alternatively, the drawstrings may be used for tying a parcel, and may thus secure the completed bow in position around a parcel or the like to be decorated by the bow.

The bow-forming ribbon may be provided to the users with an adhesive-backed card having an aperture through which the free ends of the drawstrings 13 are threaded. The adhesive-coated surface may normally be covered by a release paper which is removed after forming the bow in order to assist in securing the completed bow to a parcel or the like.

As will be appreciated, the bow-forming ribbon as illustrated may be packed flat for storage and transport. The ribbon may, for example, be folded about the narrow or neck portions 18, with the segments of the ribbon being folded one on another, to provide a compact, folded structure.

I claim:

1. A bow-forming ribbon comprising at least one longitudinally-extending decorative flexible ribbon member, a series of relatively stiff retainer members spaced apart at intervals along the length of the ribbon member and each being restrained against movement relative to the ribbon member and defining an aperture extending generally transversely across the ribbon member at an angle with respect to the transverse direction, each retainer member being located relative to the ribbon member by locating means disposing the retainer member at an angle with respect to the transverse direction different from that of the adjacent preceding retainer member, and at least one drawstring member running freely through the apertures defined by the successive retainer members.

2. Ribbon as claimed in claim 1 wherein each retainer member extends at an angle opposite to that of the preceding retainer member.

3. Ribbon as claimed in claim 1 wherein each retainer member presents generally planar front and rear faces extending generally perpendicular to the plane of the ribbon member.

4. Ribbon as claimed in claim 1 wherein each retainer member loosely engages the ribbon member and is located against movement relative thereto by locating means provided on the ribbon member.

5. Ribbon as claimed in claim 1 wherein said locating means comprise adjacent each retainer member a pair of cuts in the opposite edges of the ribbon member, the cuts being offset longitudinally from one another and opposite ends of the retainer member engaging the inner ends of the two cuts, respectively.

6. Ribbon as claimed in claim 5 wherein each edge of the ribbon member has two cuts forming a generally V-shaped indentation, the indentations being offset longitudinally from one another.

7. A bow-forming ribbon comprising two ribbon members in face to face relationship, a plurality of retainer points spaced apart regularly along the length of the ribbon members and each defined by a pair of V-shaped indentations on opposite edges of the ribbon which indentations are offset from one another at an angle which is directly oppositely to that of the indentations at the preceding retainer point, a retainer member engaging the narrowest portion of the ribbon members between the two V-shaped indentations at each retainer point and defining an aperture, and a drawstring member secured at one end to two adjacent ends of the ribbon members and running freely through the apertures formed by the successive retainer members.

8. Ribbon as claimed in claim 3 wherein each retainer member comprises a plate.

9. Ribbon as claimed in claim 7 wherein each retainer member comprises a plate.

* * * * *